US005669261A

United States Patent [19]

Castrén

[11] Patent Number: 5,669,261

[45] Date of Patent: Sep. 23, 1997

[54] APPARATUS FOR BENDING A HEAT-EXCHANGER TUBE

[75] Inventor: Risto Castrén, Lahti, Finland

[73] Assignee: Retermia Oy, Heionola, Finland

[21] Appl. No.: 532,463

[22] Filed: Sep. 22, 1995

[51] Int. Cl.[6] ..... B21D 7/024

[52] U.S. Cl. ..... 72/307; 72/388; 72/369; 72/428

[58] Field of Search ..... 72/387, 388, 217–219, 72/307, 306, 323, 369, 321, 381, 428, 424

[56] References Cited

U.S. PATENT DOCUMENTS

| | | | |
|---|---|---|---|
| 3,022 | 3/1843 | Latta | 72/323 |
| 1,512,002 | 10/1924 | Kardong | 72/388 |
| 3,857,271 | 12/1974 | Gott | 72/306 |
| 4,249,407 | 2/1981 | Fogleman | 72/217 |
| 4,681,210 | 7/1987 | Miki | 72/307 |

FOREIGN PATENT DOCUMENTS

| | | | |
|---|---|---|---|
| 502341 | 9/1992 | European Pat. Off. | 72/307 |
| 245599 | 5/1987 | Germany | 72/306 |
| 469633 | 5/1954 | Italy | 72/323 |
| 323673 | 1/1930 | United Kingdom | 72/217 |

*Primary Examiner*—Daniel C. Crane

*Attorney, Agent, or Firm*—Steinberg, Raskin & Davidson, P.C.

[57] ABSTRACT

A method and apparatus for bending a heat-exchanger tube, which heat-exchanger tube have heat-exchanger ribs preferably having a needle construction. In the method and apparatus, the heat-exchanger tubes are placed one above the other to be defined by one another to form a battery. The battery of heat-exchanger tubes is fed first into a first bending-device portion of the bending device in which the heat-exchanger tube is bent in one direction. After this, the tube battery is fed further, and the bending is performed in the second bending-device portion in the opposite direction of bending, whereby a wave-shaped form is obtained.

21 Claims, 13 Drawing Sheets

APPARATUS FOR BENDING A HEAT-EXCHANGER TUBE

FIELD OF THE INVENTION

The present invention relates generally to a method and an apparatus for bending a heat-exchanger tube and specifically to a battery of stacked heat exchanger tubes.

BACKGROUND OF THE INVENTION

In the prior art, constructions are known in which the heat-exchanger tube is bent into wave-shaped form so as to form a construction in which the heat-exchanger tubes are placed side by side and, by means of the construction, a heat-exchange wall is formed,through which air is passed. In a wave-shaped needle-tube construction, the same tube requires different bending radii in successive bends to form a wave-shaped wall construction. In the wall construction, the same tube may be alternatingly in a position that requires the minimum bending radius and thereupon in a position that requires the maximum bending radius. The needle tube is brought into wave form by bending it in two different directions. The wave-shaped tubes are placed one on top of the other, the needles on the needle tube being arranged as partly interlocked in relation to one another and forming a wall construction. By means of the wave form, a heat face as large as possible is formed, through which face air is made to flow from outdoors into a central blower and further into the building.

OBJECTS AND SUMMARY OF THE INVENTION

It is an object of the present invention to provide an new and improved method and apparatus for bending heat a exchanger tube and more particularly to bending a stacked plurality of heat exchanger tubes.

In the present invention, an apparatus is described for bending a heat-exchanger tube into the shapes required by a wave-shaped wall construction.

According to the invention, the needle tube is passed to the location of the first bending back stop or bending disc. After the needle tube has been fed a certain distance beyond this disc, a bending blade is placed against the tube, and the tube is bent so that the tube obtains the shape determined by the curve form of the bending disc. After this, the bending blade is brought apart from the needle tube, and the tube is fed further forwards, and bending is carried out at a second bending disc, which has, for example, a larger radius, by means of the same method in the opposite bending direction. After this, the bending steps are repeated as desired. Between the bending steps, the tube is fed forwards.

In the construction in accordance with the invention, in the same stage, several tubes are bent at the same time. This has been arranged so that the tubes are placed one above the other in a separate feed magazine, whereby a whole battery of tubes can be bent at the same time.

The method for bending a plurality of elongate heat-exchanger tubes, comprising the steps of stacking the heat-exchanger tubes one in a column to form a battery of heat-exchanger tubes, feeding the battery of heat-exchanger tubes in a longitudinal direction into a bending apparatus, bending the battery of heat-exchanger tubes in a first bending direction in the bending apparatus, then further feeding the battery of heat-exchanger tubes in the longitudinal direction, and bending the battery of heat-exchanger tubes in the bending apparatus in a second bending direction opposite to the first bending direction, whereby the battery of heat-exchanger tubes obtains a wave-shaped form. The heat-exchanger tubes are bent in the first and second bending directions by pivoting a bending blade into engagement with the battery of heat-exchanger tubes such that guide faces on the bending blade are placed against sides of the heat-exchanger tubes, and operating a pivot shaft connected with the bending blade to bend the heat-exchanger tubes against a face of a backing stop. The face of the bending back stop has a curve form which determines the curve form of bending of the battery of heat-exchanger tubes. The battery of heat-exchanger tubes is locked in a precise position in relation to the bending back stops before bending of the battery of heat-exchanger tubes.

The bending apparatus for bending a plurality of heat-exchanger tubes, comprising first and second bending means arranged to define a passage therebetween for passage of the tubes, each of the first and second bending means comprising a pivot shaft, a bending blade coupled to the pivot shaft, and first actuating means for moving the bending blade into engagement with the tubes to bend the tubes.

In the following, the invention will be described with reference to some preferred embodiments of the invention illustrated in the figures in the accompanying drawings. However, the invention is not confined to these embodiments alone.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1A:
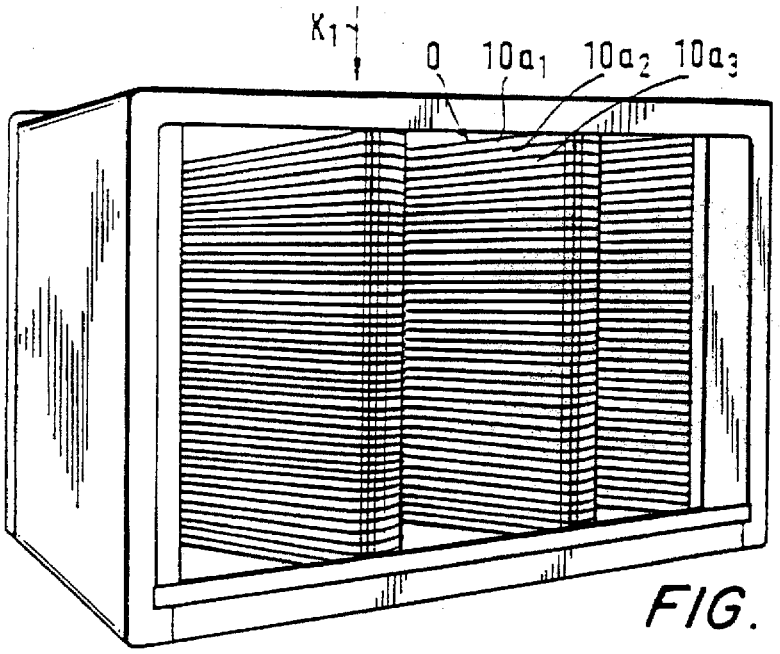
FIG. 1A is an axonometric view of a heat-exchanger wall construction produced in the invention.
Figure 1B:
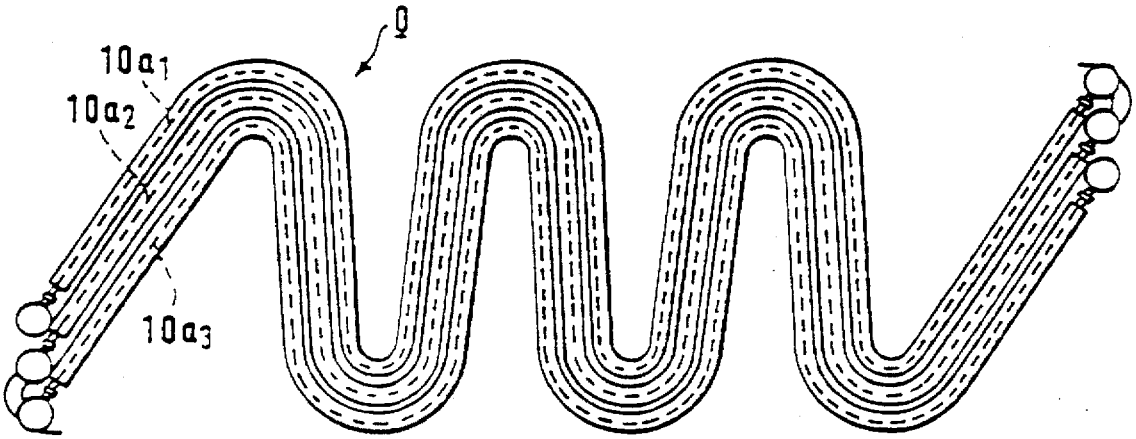
FIG. 1B is a top view of the wall construction of FIG. 1A.

Referring to the accompanying drawings wherein the same reference numerals refer to the same or similar elements, FIG. 1A is an axonometric view of a heat-exchanger construction produced in the invention. The construction comprises a number of needle tubes $10a_1$,$10a_2$, $10a_3$ placed side by side and one above the other to form a battery of tubes O. FIG. 1B shows the wall construction of FIG. 1A viewed from above with a plurality of bending locations, whereby the wave-form of the battery of tubes O can be seen.

Figure 1C:
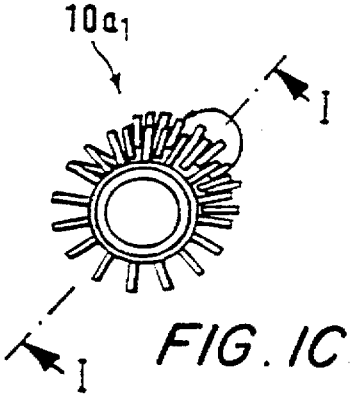
FIG. 1C is an axonometric illustration of the shape of one heat-exchanger needle tube in the wall construction.

FIG. 1C is an axonometric view of an individual needle tube $10a_1$. The heat-exchanger tube $10a_1$ comprises needles or equivalent as heat-exchanger ribs.

Figure 1D:
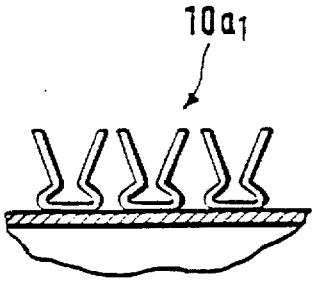
FIG. 1D is a sectional view taken along the line I—I in FIG. 1C.

FIG. 1D illustrates the cross-sectional form of the heat-exchanger needle band fitted on the needle-heat-exchanger tube $10a_1$ that is used.

Figure 2A:
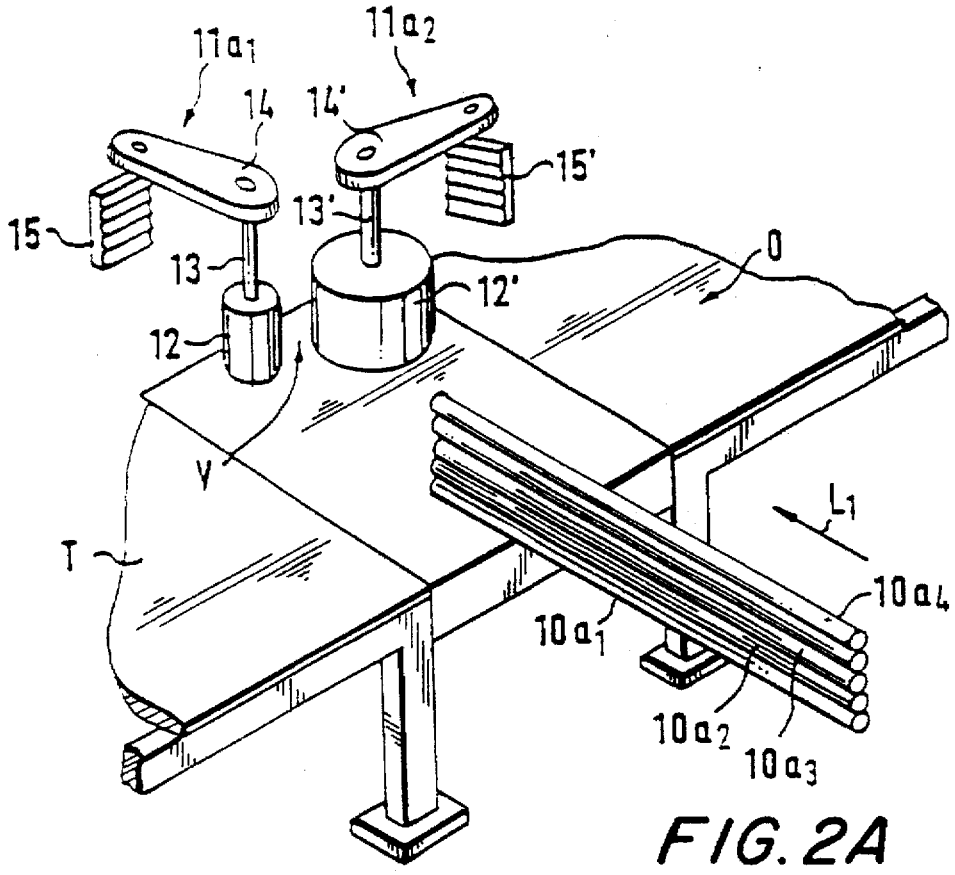
FIGS. 2A, 2B, 2C, 2D, 2E and 2F show stages in which the bending of a battery of needle tubes is carried out by means of the first bending blade and the bending back stop.

As shown in FIG. 2A, the adjacent needle tubes $10a_1$, $10a_2$, $10a_3$ and $10a_4$ are introduced (in the direction of arrow $L_1$) as a battery O of tubes to the vicinity of bending back stops 12,12' of the bending device 11 in accordance with the invention. The bending device 11 comprises two bending-device portions $11a_1$ and $11a_2$. Each portion $11a_1$ and $11a_2$ comprises a similar construction of equipment. For example, the bending-device portion $11a_1$ comprises a bending back stop 12, a pivot shaft 13, a bending arm 14, and a bending blade 15. The bending blade 15 comprises adjacent curved guide faces $C_1$,$C_2$,$C_3$ and $C_4$ having a semi-circular section to be placed against the ends of the needle ribs on the tubes.

Figure 2B:
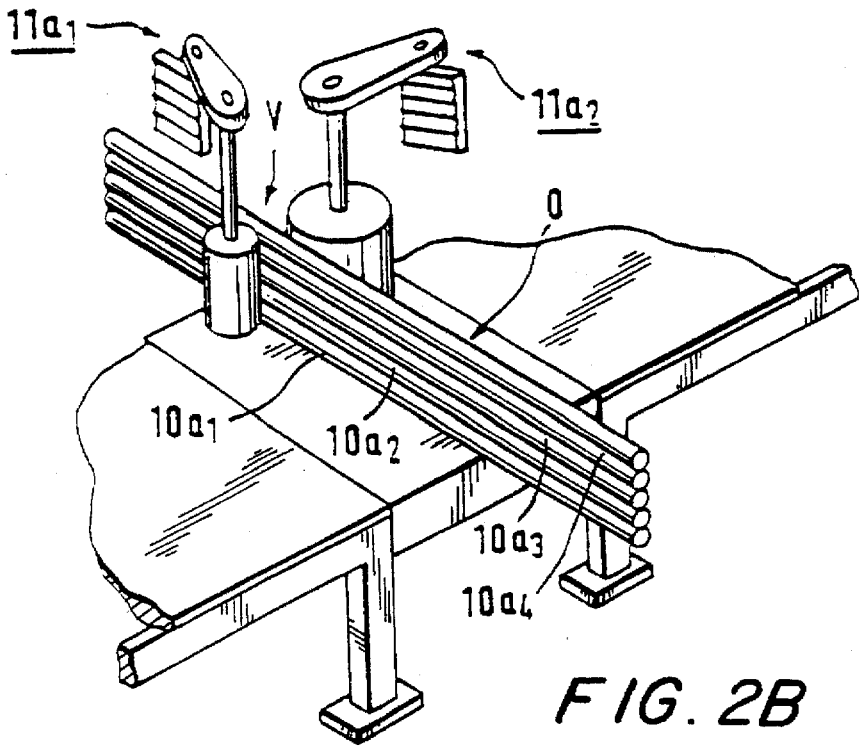
Figure 2C:
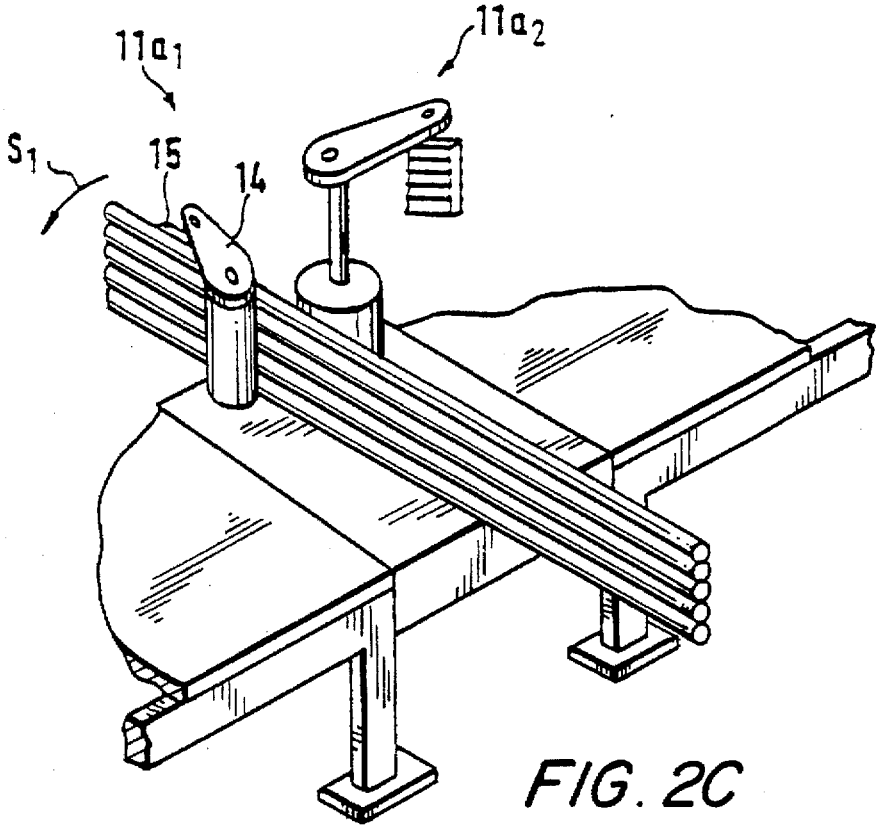
Figure 2D:
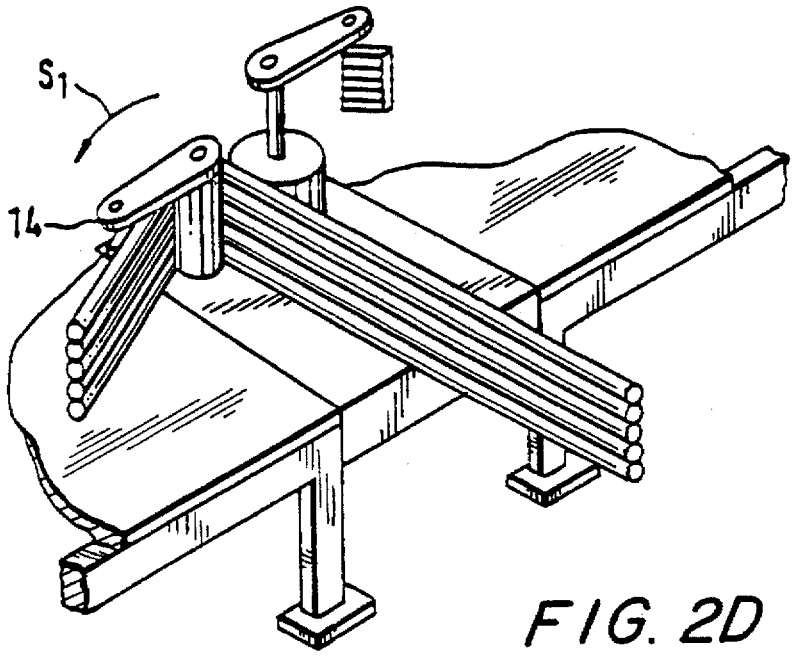

The process of bending the battery of tubes O will now be described. As shown in FIG. 2B, the bending blade of the first bending-device portion is placed at the side of the tube battery 0 while the pivot shaft 13 of the bending blade 15 is in the upper position. After this, the pivot shaft 13 is lowered to the lower position (FIG. 2C), and in the manner shown in FIG. 2D, the tube battery 0 is bent against the bending back stop 12, preferably a curved face, of the first bending device portion (FIG. 2D) (arrow $S_1$). The radius of the bending back stop 12 determines the bending of the battery of tubes O.

Figure 2E:
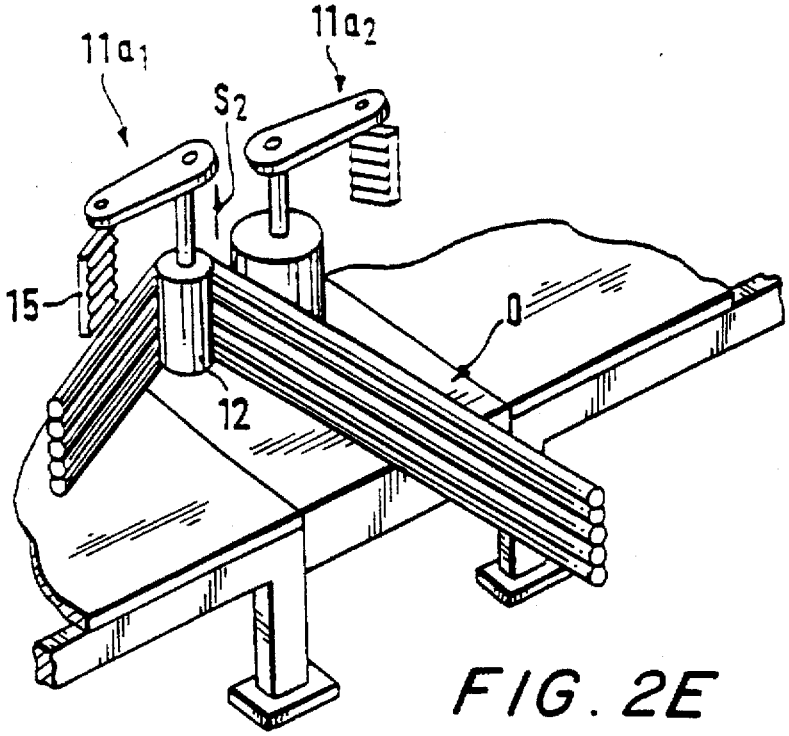
Figure 2F:
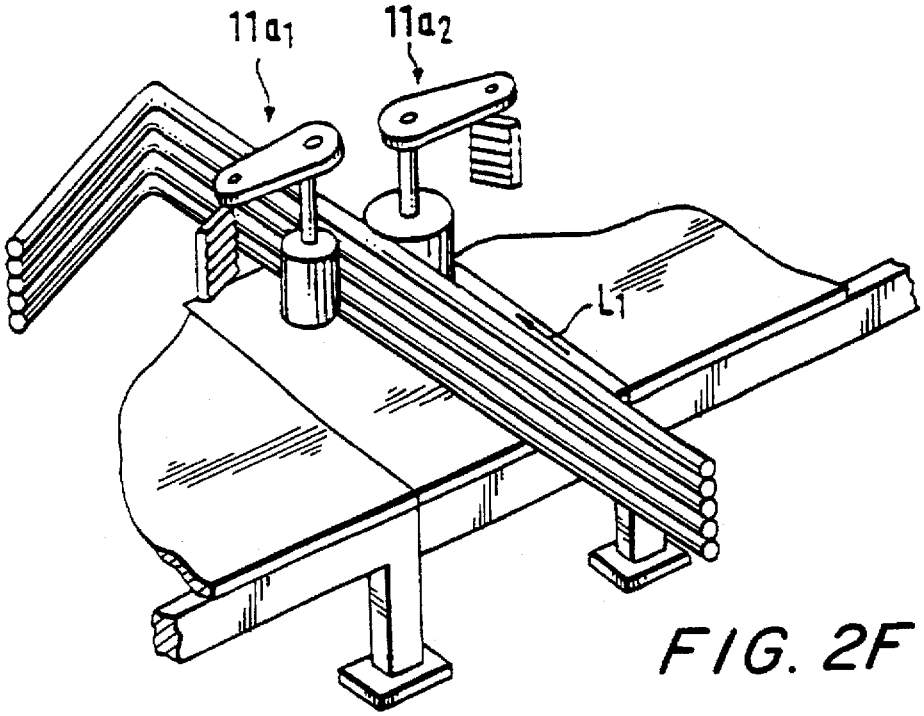

Next, in the manner shown in FIG. 2E, the bending blade 15 is raised (arrow $S_2$) apart from the tube battery O, and as shown in FIG. 2F, the tube battery 0 is fed further forward.

Figure 2G:
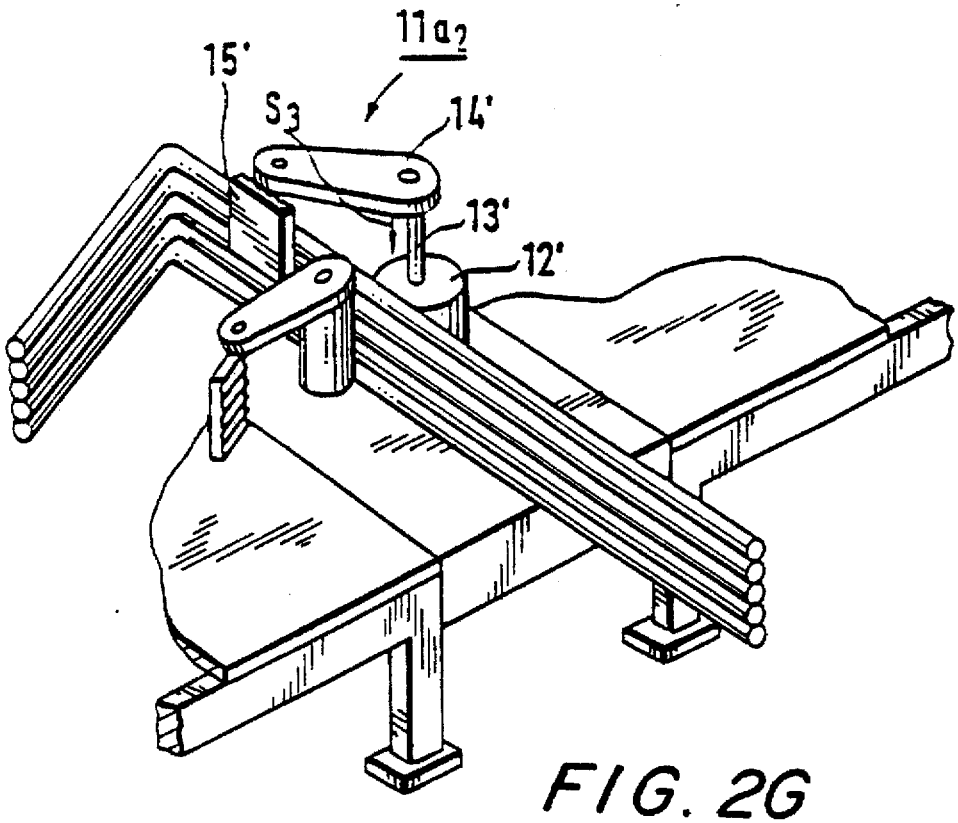
FIGS. 2G, 2H, 2I, 2J and 2K show stages in which the bending of the battery of needle tubes takes place by means of the second bending blade and the bending back stop.
Figure 2H:
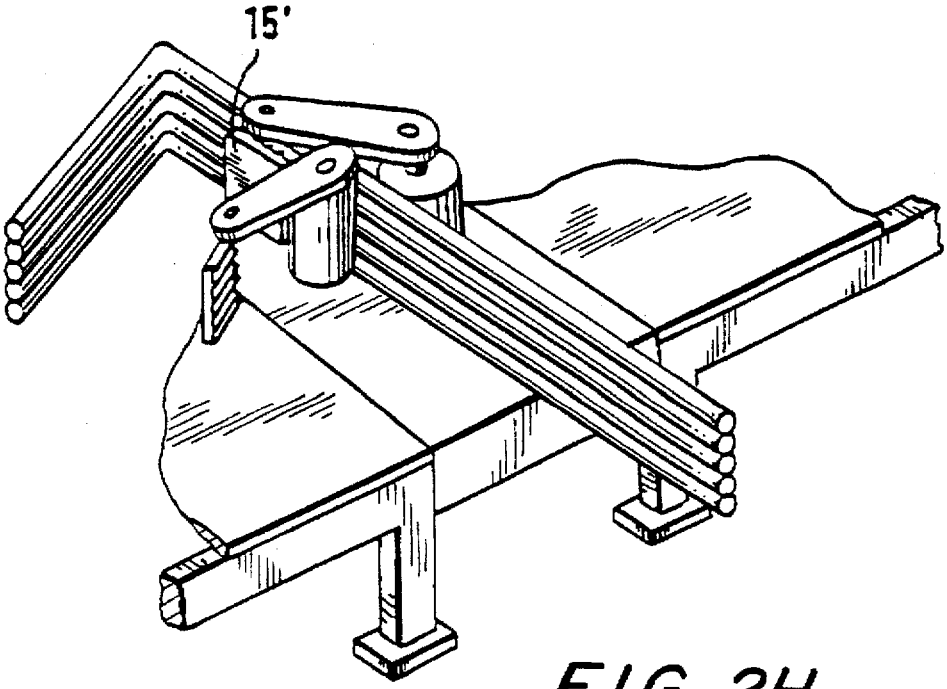
Figure 2I:
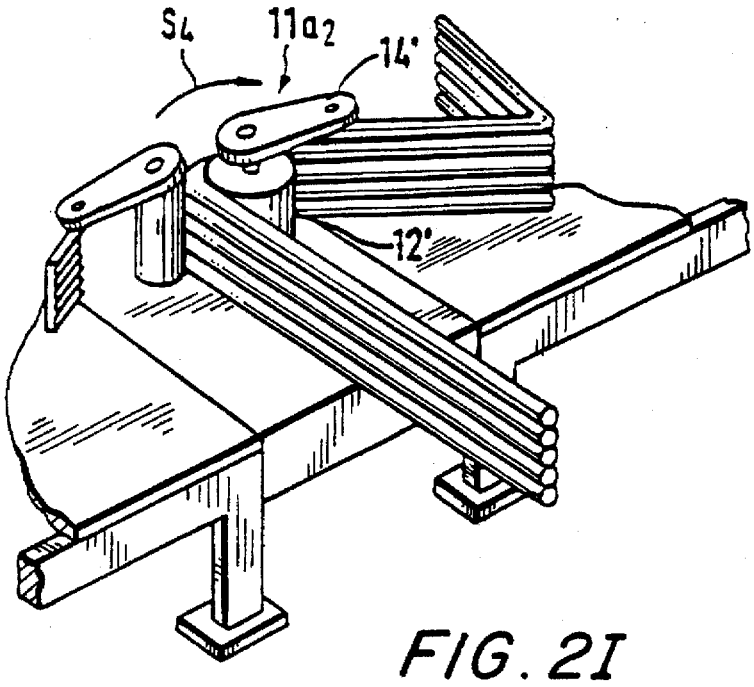
Figure 2J:
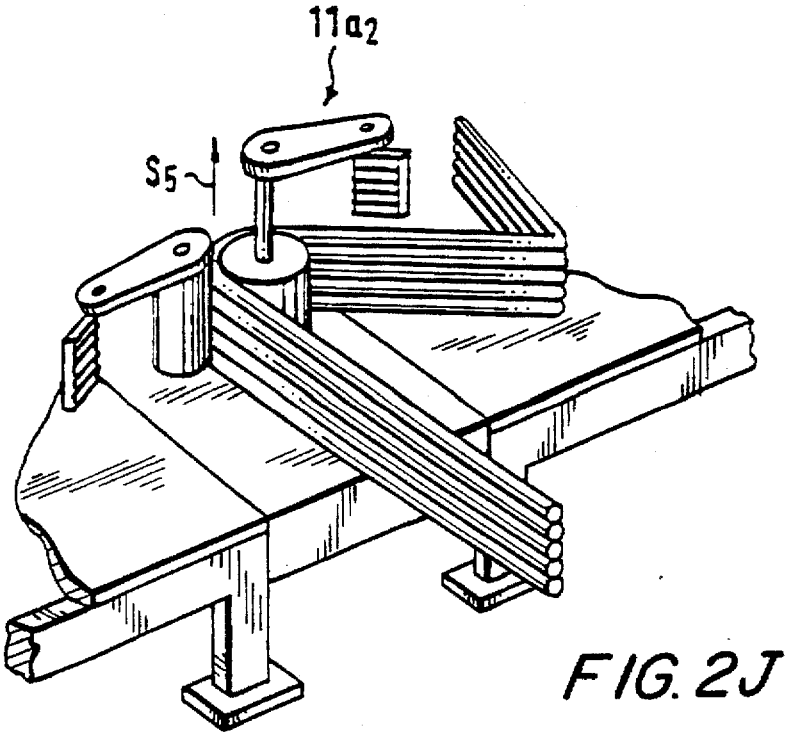
Figure 2K:
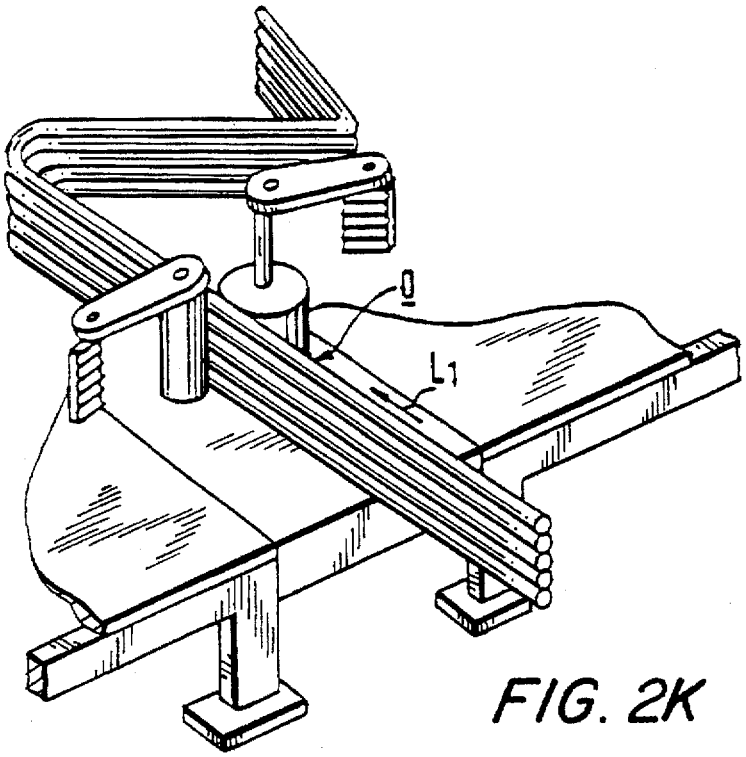

As shown in FIG. 2G, after this, the bending blade 15' of the second bending-device portion $11a_2$ is transferred to the side of the tube battery O, and it is lowered to the lower position (arrow $S_3$, the resting position being shown in FIG. 2H), to the other side of the tube battery O, and bending is carried out (arrow $S_4$), in the opposite direction, in the way shown in FIG. 2I, against the face of the bending back stop 12' having, e.g., a larger radius than the radius of back stop 12. After this, the bending blade 15' of the second bending-device portion $11a_2$ is raised apart from the tube battery O, and the tube battery O is shifted further, and the working steps are repeated as desired. Thus, the working steps of the second bending-device portion $11a_2$ are similar to those of the first bending-device portion $11a_1$. Now the bending of the needle tube takes place in the direction opposite to the direction of bending taking place by means of the bending-device portion $11a_1$. The steps of bending are illustrated in FIGS. 2G–2K sequentially.

Figure 3:
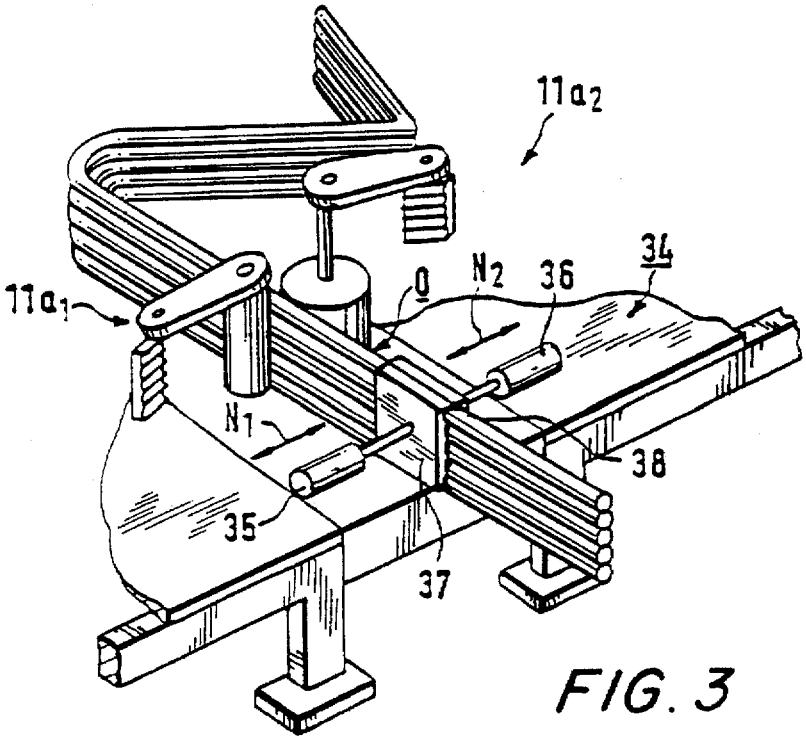
FIG. 3 shows a locking device placed in direct vicinity of the bending back stops or bending discs in the bending machine.

As illustrated in FIG. 3, the apparatus also comprises a locking device 34 by whose means the tube battery O is engaged in a precise position in relation to the table T and to the bending back stops 12,12' before bending. The locking device 34 may comprise, for example, pneumatic cylinders 35,36 by whose means locking back-stops 37,38 are displaced towards one another (arrows $N_1$,$N_2$) in the locking situation, and thereby the tube battery O is locked. After the bending, the locking force of the cylinders 35,36 is released, and the tube battery O is shifted further in the manner indicated by the arrow $L_1$ in FIG. 3.

Figure 4A:
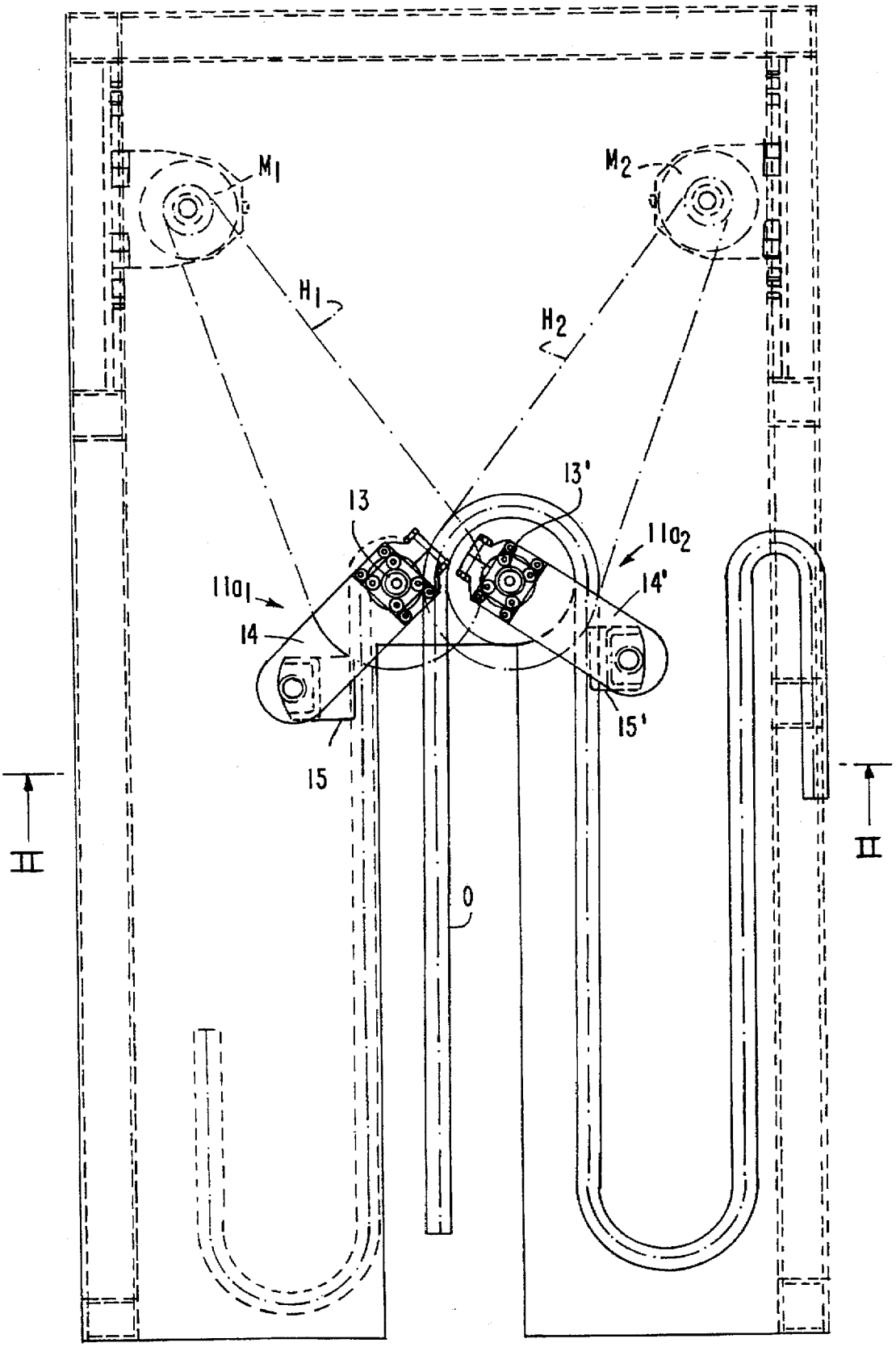
FIG. 4A is a top view of a preferred embodiment of the apparatus in accordance with the invention.

FIG. 4A is a top view of a preferred embodiment of the construction of the device in accordance with the invention. The apparatus comprises motors $M_1$ and $M_2$ by whose means pivot shafts 17,17' are rotated via drive pulleys 16,16'. The drive from the motors $M_1$,$M_2$ to the drive pulleys 16,16'0 is transferred, e.g., by means of cogged belts $H_1$,$H_2$.

Figure 4B:
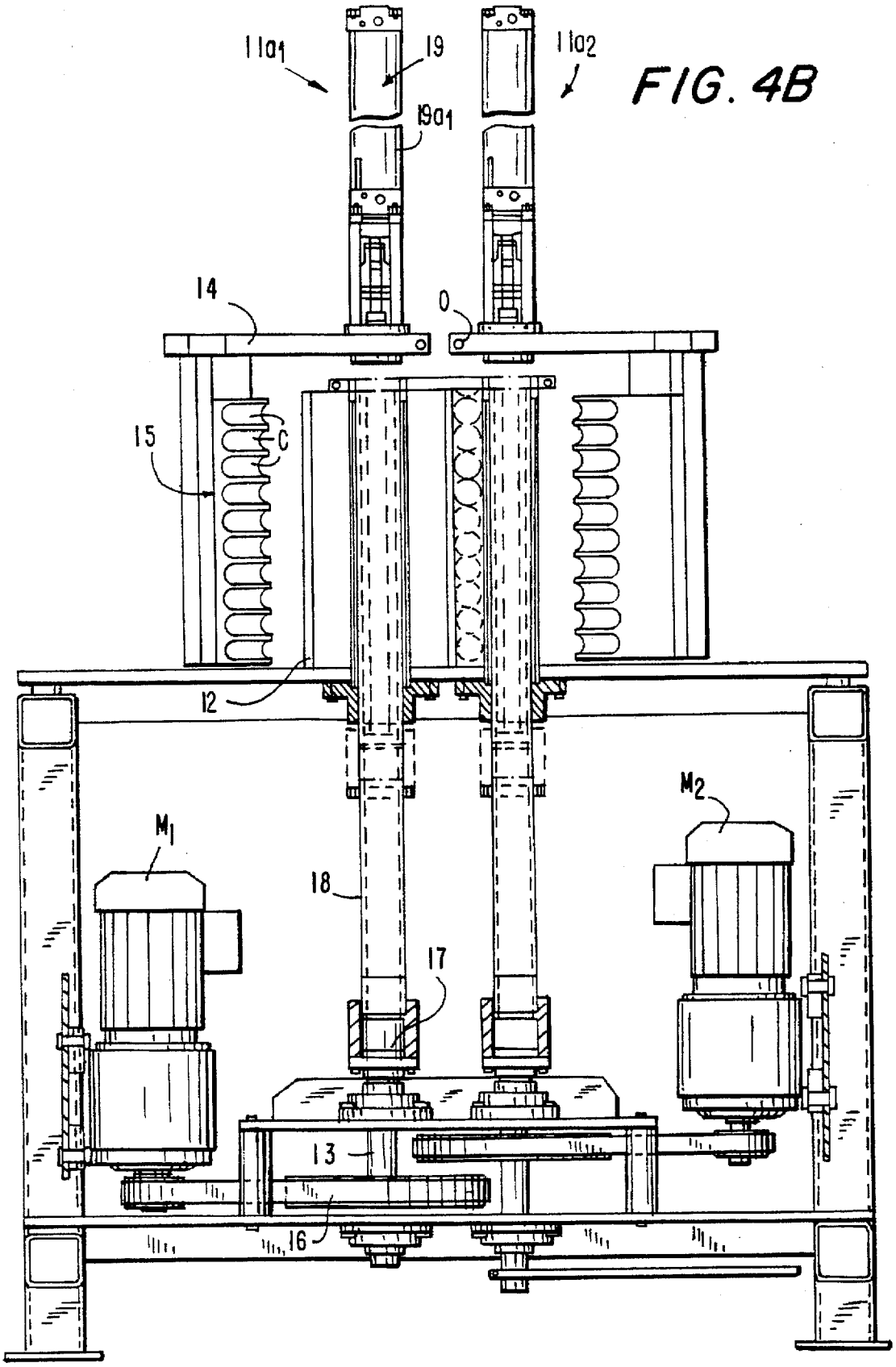
FIG. 4B is a sectional view taken along the line II—II in FIG. 4A.
Figure 5:
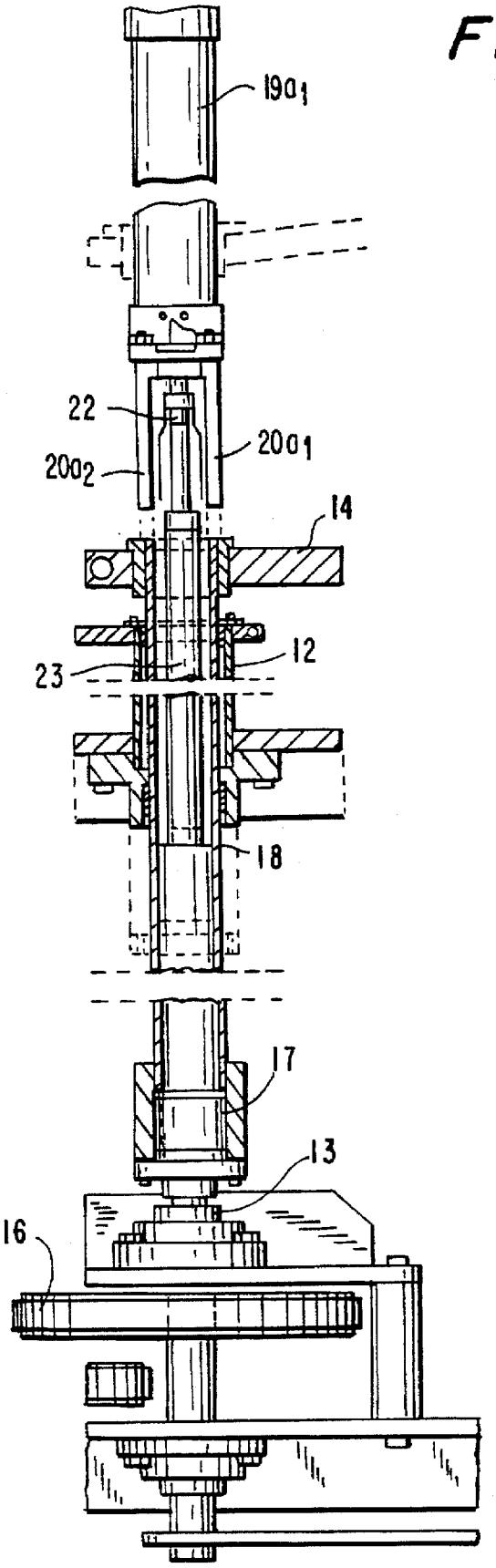
FIG. 5 shows one bending-device portion of the bending device as a separate illustration in view of detailed illustration of the construction.

FIG. 4B is a sectional view taken along the line II—II in FIG. 4A. FIG. 5 is a more detailed illustration of the bending-device portion $11a_1$. The apparatus comprises two bending-device portions with equal components of construction, i.e. the bending-device portions $11a_1$ and $11a_2$. The bending-device portion $11a_1$ comprises a pivot shaft 13, on which the drive pulley 16, preferably a cogged pulley, is mounted. In the way described above, the drive pulley 16 is driven from the motor $M_1$ by means of a belt $H_1$, preferably a cogged belt. The central shaft 13 of the drive pulley 16 further rotates an outside shaft 18 connected with it by means of a central grooved joint 17. The shaft 18 slides along the outer face of the shaft 13, and the shaft 18 is connected with an actuator cylinder 19 from the cylinder frame $19a_1$ by the intermediate of the arms $20a_1$, $20a_2$ . . . A piston rod 22 of the cylinder is further connected with the central shaft 13 by means of extension shafts 23. Thus, when the pressure is introduced into the cylinder device, the cylinder frame $19a_1$ is raised, and in this way it is possible to displace the pivot arm 14 connected with the cylinder frame $19a_1$, and, further, the bending blade 15. The pivoting of the bending blade 15 itself takes place in the way described above by operating the motor $M_1$ and by rotating the shaft 13. The bending blade 15 is connected in a stationary position on, i.e., operatively fixed to, the pivot arm 14. The construction of the second bending-device portion $11a_2$ which is placed at the side of the bending-device portion $11a_1$ of the bending device, is similar, and its constructional parts are denoted with an apostrophe.

Figure 6:
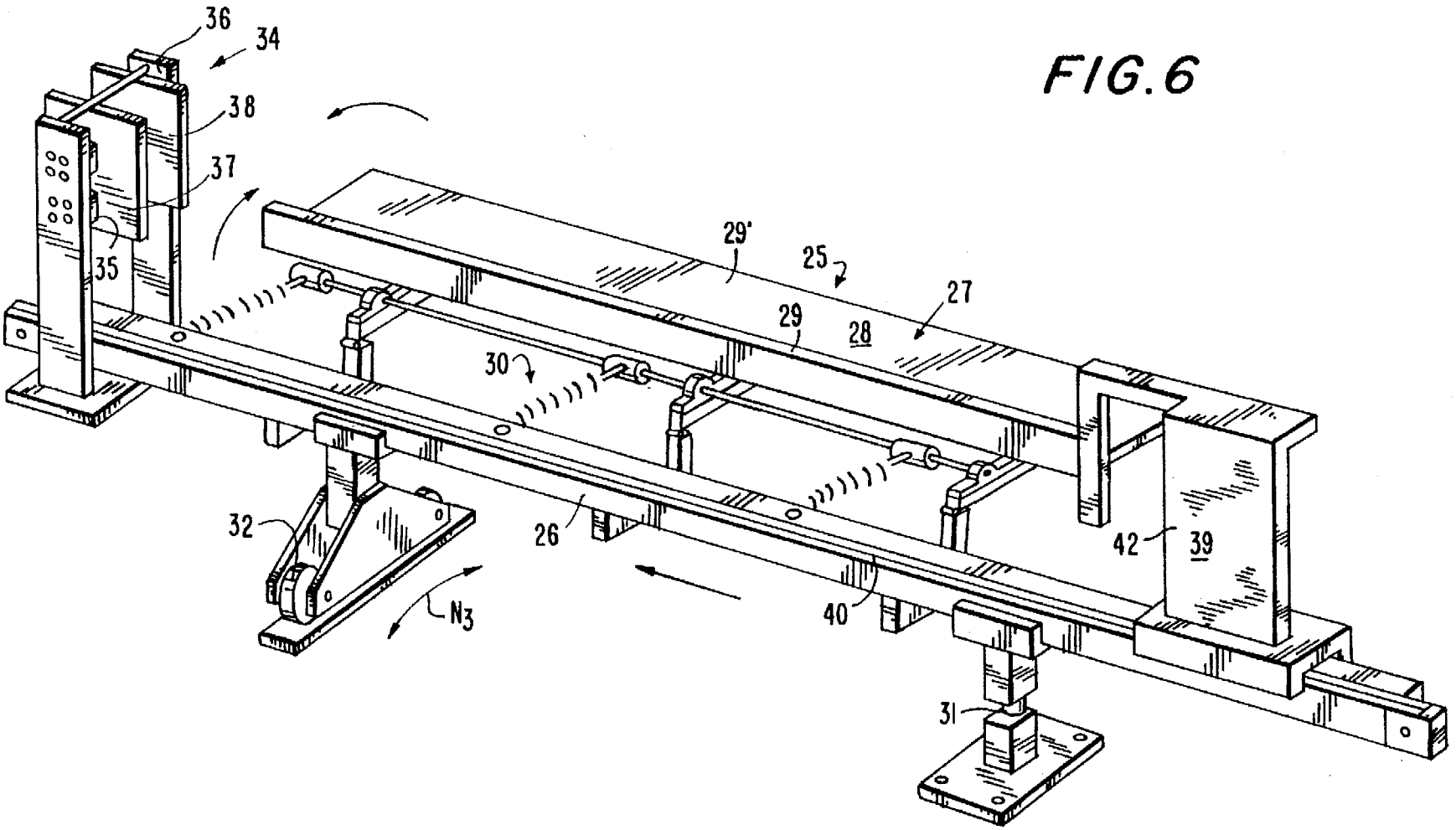
FIG. 6 shows the feed device of the bending apparatus in accordance with the invention, by means of which feed device the needle tubes, which have been placed one above the other, are fed into connection with the bending back stops of the bending device and by whose means the bent needle tube is fed forwards onto the base table. In the stage shown in FIG. 6, the magazine is open, which permits stacking of the needle tubes in the feed magazine.

FIG. 6 shows a feeder device 25 connected with the bending apparatus in accordance with the invention. The feeder device shown in FIG. 6 comprises a base frame 26 and a pivot frame 27 mounted pivotally thereon. The needle tubes $10a_1$, $10a_2$,$10a_3$ . . . are placed in a magazine space 28 of the pivot frame 27 against a bottom part 29 and a side wall 29' of the magazine space. When the pivot frame 27 is pivoted to the upper position, support wall 30 is pivoted so as to form the other wall of the magazine space 28. The needle tubes $10a_1$,$10a_2$ are placed between their support walls 27,30) and the wall 29 of the magazine space, i.e., the bottom part. According to the invention, the base frame can be positioned in relation to the bending back stops, i.e., the bending discs 12,12', by displacing it around an articulated joint 31 placed at its forward end on support of the wheels 32 (arrow $N_3$). The needle tubes $10a_1$,$10_2$ . . . are fed forward in the magazine 28 by pushing from the ends of the needle tubes $10a_1$,$10a_2$ . . .

Furthermore, as shown in FIG. 6, the feeder device 25 comprises the tube $10a_1$,$10a_2$ . . . locking device 34 in connection therewith, which device 34 comprises actuators 35 and 36, preferably pneumatic cylinders, by whose means the locking back stops 37,38 are displaced. The tubes $10a_1$,$10a_2$ . . . are passed between the locking back stops 37,38. When the locking back stops are displaced in the directions $N_1$,$N_2$, the tubes $10a_1$,$10_2$ are pressed between the locking back stops 37,38.

Figure 8:
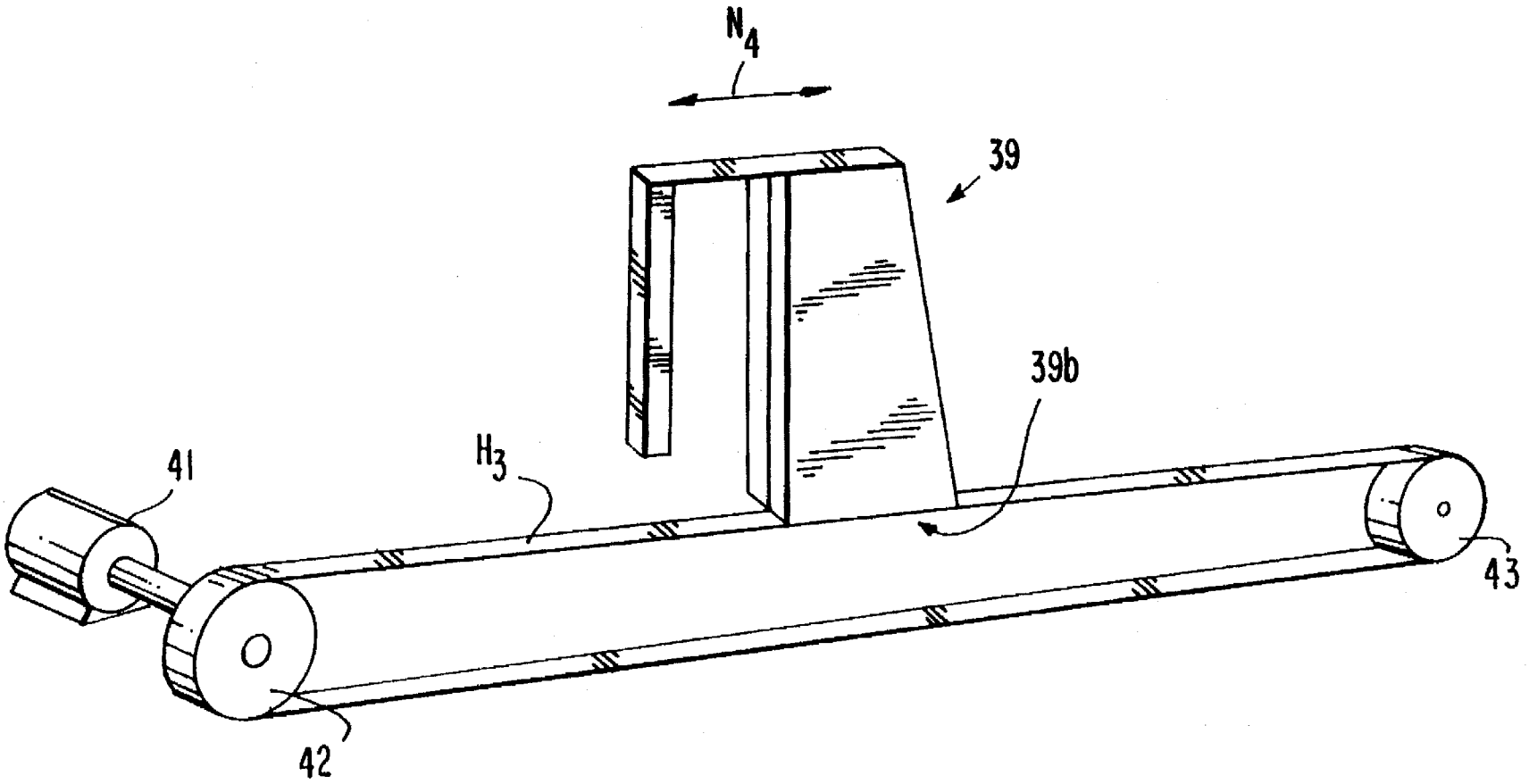
FIG. 8 shows the arrangement of displacing the thrust member.

Further, the apparatus comprises a thrust member 39 displaceable in relation to the base frame. The thrust member is displaced in a horizontal guide 40 by means of an actuator 41, preferably an electric motor, by displacing a cogged belt $H_3$, which is in engagement with a bottom side 39*b* of the thrust member 39 (FIG. 8). The thrust member 39 comprises a vertical support face 42, which is pressed against the ends of the needle tubes $10a_1$,$10a_2$ . . . which are fed to the bending back stops 12,12' of the bending device 11.

Figure 7:
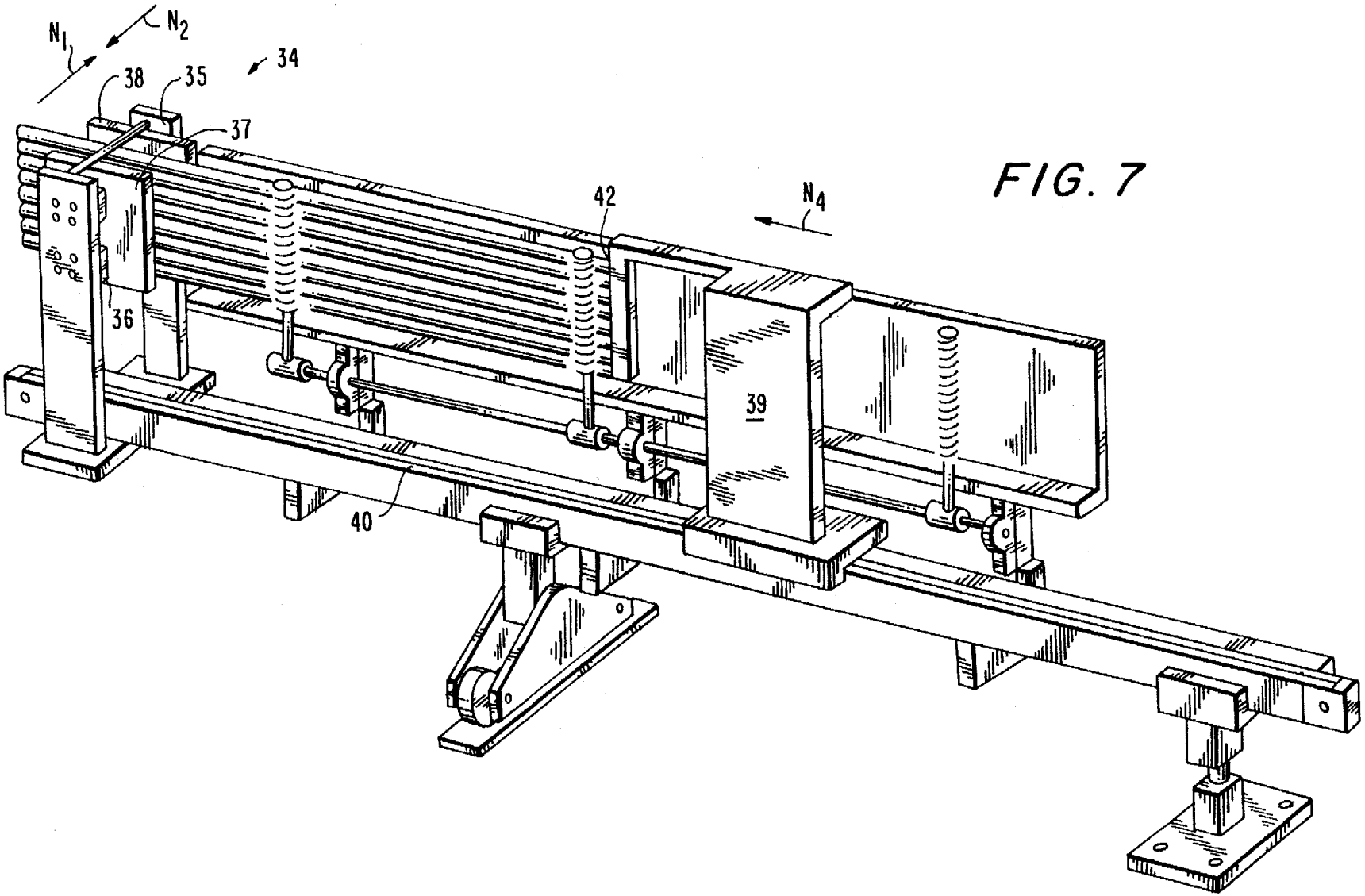
FIG. 7 shows the stage in which the thrust member has pushed the needle tubes in the magazine forwards into the space between the bending back stops of the bending-device portions in the bending machine.

FIG. 7 shows a stage in which the thrust member 39 has pushed the needle tubes $10a_1$,$10a_2$ in the magazine forwards into connection with the rolls, i.e., the bending back stops 12,12', in the bending machine and in which the locking device 34 locks the needle tubes $10a_1$,$10a_2$ . . . in the feed position between the locking back stops 37,38. The thrust member is guided along the guide 40.

FIG. 8 illustrates the arrangement of shifting of the thrust member 39. By means of the motor 41, the belt $H_3$ is displaced (arrow $N_4$), which belt is in engagement with the thrust member 39. The belt H3 is passed over the reversing pulleys 42,43, and it forms a closed loop.

The examples provided above are not meant to be exclusive. Many other variations of the present invention would be obvious to those skilled in the art, and are contemplated to be within the scope of the appended claims.

I claim:

1. A bending apparatus for bending a plurality of heat-exchanger tubes, comprising first and second bending means for bending the tubes, said first and second bending means being arranged in opposed relationship to one another to define a passage therebetween through which the tubes are passed in a first direction, each of said first and second bending means comprising a pivot shaft having a geometric axis oriented in a second direction perpendicular to the first direction, a bending blade coupled to said pivot shaft, first actuating means for pivoting said pivot shaft around its geometric axis to thereby move said bending blade into engagement with the tubes to bend the tubes, and second actuating means for displacing said pivot shaft in the second direction.

2. The bending apparatus of claim 1, wherein the tubes comprise heat-exchanger ribs having a needle construction.

3. The bending apparatus of claim 1, wherein said pivot shaft includes a pivot arm, said bending blade being connected to said pivot arm.

4. The bending apparatus of claim 1, wherein said bending blades comprise adjacent curved guide faces adapted to engage with a respective one of the tubes.

5. The bending apparatus of claim 1, wherein each of said first and second bending means further comprise bending back stops against which said bending blade bends the tubes, further comprising locking means for locking the tubes in a precise position relative to said bending back stops.

6. The bending apparatus of claim 1, wherein said first actuating means comprise a motor for rotating said pivot shaft, a cogged belt coupled to said motor, and a drive pulley engaging with said cogged belt and being connected to said pivot shaft.

7. The bending apparatus of claim 1, wherein said pivot shaft comprises a grooved joint, an outside shaft connected to said grooved joint such that said outside shaft is vertically mobile but rotationally rigid with respect to said grooved joint, a cylinder connected to said shaft, said cylinder including a cylinder frame and a piston rod, said piston rod being coupled through a central shaft to said first actuating means.

8. The bending apparatus of claim 5, wherein said locking means comprises at least one cylinder device by whose means a locking back stop is displaced, the tubes being shifted forward in a space defined between said locking back stops and being pressed between said locking back stops during locking.

9. The bending apparatus of claim 7, further comprising a feeder device comprising a base frame, a pivot frame mounted pivotally on said base frame, said pivot frame being movable to a vertical position, and a separate support wall movable into a vertical position, and the tubes being stacked in a magazine space of said pivot frame and being displaceable in said space forward toward said first and second bending means.

10. The bending apparatus of claim 1, further comprising a thrust member having a vertical face for engaging ends of the tubes and a separate motor for directing said thrust member, and guide means for guiding the thrust member.

11. The bending apparatus of claim 9, wherein said base frame is pivotable in a horizontal plane on support of an articulated joint and wheels.

12. A bending apparatus for bending a plurality of heat-exchanger tubes, comprising first and second bending means for bending the tubes, said first and second bending means being arranged in opposed relationship to one another to define a passage therebetween through which the tubes are passed, each of said first and second bending means comprising a pivot shaft, a bending blade coupled to said pivot shaft, first actuating means for moving said bending blade into engagement with the tubes to bend the tubes, bending back stops against which said bending blade bends the tubes upon movement of said bending blade by said first actuating means, and locking means for locking the tubes in a precise position relative to said bending back stops.

13. The bending apparatus of claim 12, wherein said locking means comprise at least one cylinder device by whose means a respective locking back stop of said first and second bending means is displaced, the tubes being shifted forward in a space defined between said locking back stops and being pressed between said locking back stops during locking.

14. The bending apparatus of claim 12, wherein the tubes comprise heat-exchanger ribs having a needle construction.

15. The bending apparatus of claim 12, wherein said pivot shaft includes a pivot arm, said bending blade being connected to said pivot arm.

16. The bending apparatus of claim 12, wherein said bending blades comprise adjacent curved guide faces adapted to engage with a respective one of the tubes.

17. The bending apparatus of claim 12, wherein said first actuating means comprise a motor for rotating said pivot shaft, a cogged belt coupled to said motor, and a drive pulley engaging with said cogged belt and being connected to said pivot shaft.

18. The bending apparatus of claim 12, wherein said pivot shaft comprises a grooved joint, an outside shaft connected to said grooved joint such that said outside shaft is vertically mobile but rotationally rigid with respect to said grooved joint, a cylinder connected to said shaft, said cylinder including a cylinder frame and a piston rod, said piston rod being coupled through a central shaft to said first actuating means.

19. The bending apparatus of claim 12, further comprising a thrust member having a vertical face for engaging ends of the tubes and a separate motor for directing said thrust member, and guide means for guiding the thrust member.

20. A bending apparatus for bending a plurality of heat-exchanger tubes, comprising first and second bending means for bending the tubes, said first and second bending means being arranged in opposed relationship to one another to define a passage therebetween through which the tubes are passed, each of said first and second bending means comprising a pivot shaft, a bending blade coupled to said pivot shaft, and first actuating means for moving said bending blade into engagement with the tubes to bend the tubes, and a feeder device comprising a base frame, a pivot frame mounted pivotally on said base frame, said pivot frame being movable to a vertical position, and a separate support wall movable into a vertical position, the tubes being stacked in a magazine space of said pivot frame and being displaceable in said space forward toward said first and second bending means.

21. The bending apparatus of claim 20, wherein said base frame is pivotable in a horizontal plane on support of an articulated joint and wheels.

* * * * *